US011708200B1

(12) United States Patent
Xu et al.

(10) Patent No.: US 11,708,200 B1
(45) Date of Patent: Jul. 25, 2023

(54) POWDER DISPENSING APPARATUS FOR DISPENSING FIXED AMOUNT OF POWDER AND PORTABLE POWDER STORING BOTTLE

(71) Applicant: SHENZHEN JINGDU TECHNOLOGY CO., LTD., Shenzhen (CN)

(72) Inventors: Shaoyuan Xu, Shenzhen (CN); Tiejun Li, Shenzhen (CN); Huchun Xiao, Shenzhen (CN)

(73) Assignee: SHENZHEN JINGDU TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 18/096,659

(22) Filed: Jan. 13, 2023

Related U.S. Application Data

(63) Continuation of application No. PCT/CN2022/138117, filed on Dec. 9, 2022.

(30) Foreign Application Priority Data

Jul. 14, 2022 (CN) ..... 202221816689.1

(51) Int. Cl.

| | |
|---|---|
| ***B65D 51/28*** | (2006.01) |
| ***B65D 81/32*** | (2006.01) |
| ***B65D 83/06*** | (2006.01) |
| ***B65D 47/12*** | (2006.01) |
| ***B65D 47/26*** | (2006.01) |

(52) U.S. Cl.
CPC ..... *B65D 51/2857* (2013.01); *B65D 47/127* (2013.01); *B65D 47/26* (2013.01); *B65D 81/3211* (2013.01); *B65D 83/06* (2013.01)

(58) Field of Classification Search
CPC ..... B65D 51/2864; B65D 25/087; B65D 81/3211; B65D 81/3205
See application file for complete search history.

(56) References Cited

U.S. PATENT DOCUMENTS

| | | | | |
|---|---|---|---|---|
| 5,692,644 | A * | 12/1997 | Gueret | B05B 11/0083 222/129 |
| 2011/0048545 | A1* | 3/2011 | Polatov | B65D 51/2864 137/15.01 |
| 2018/0186528 | A1* | 7/2018 | Tonn | G01F 11/16 |

* cited by examiner

*Primary Examiner* — Mollie Impink
(74) *Attorney, Agent, or Firm* — Daniel M. Cohn; Howard M. Cohn

(57) ABSTRACT

The present application relates to milk powder packaging field. The present application provides a powder dispensing apparatus for dispensing fixed amount of powder, including a powder outputting member, a bottle mouth connecting assembly and a plurality of resetting members, the powder outputting member has a powder outlet, the bottle mouth connecting assembly includes a valve and a bottle mouth connecting member, the bottle mouth connecting member has a sliding groove, each the resetting member is located in the sliding groove, one end of each resetting member is connected to the bottom of the sliding groove, the other end is connected to the powder outputting member, the valve and the powder outlet are detachably connected, a side of the bottle mouth connecting member deviating from the valve is connected to the powder storing bottle. The present application improves the accuracy of fixed amount of powder dispensing.

16 Claims, 12 Drawing Sheets

POWDER DISPENSING APPARATUS FOR DISPENSING FIXED AMOUNT OF POWDER AND PORTABLE POWDER STORING BOTTLE

CROSS-REFERENCE TO RELATED APPLICATIONS

This application is a continuation of International Application No. PCT/CN2022/138117, filed on Dec. 9, 2022, which claims the priority of Chinese Patent Application No. 202221816689.1, filed on Jul. 14, 2022, which are hereby incorporated by reference in their entireties.

TECHNICAL FIELD

The present application relates to milk powder packaging field, more particularly to a powder dispensing apparatus for dispensing fixed amount of powder and a portable powder storing bottle including the powder dispensing apparatus.

BACKGROUND

Traditional powder storing bottles have the function of predetermined and fixed powder dispensing, such as the utility model patent with the publication number CN208957798U, which discloses a portable powder storing and milk warming kit. The structure of the portable powder storing and milk warming kit with the fixed powder dispensing function includes a powder discharge switch, a valve stem, a powder metering valve, a powder discharge valve, and return springs, the powder discharge switch is located on the lower cap of the powder storing bottle, the powder discharge switch is connected with the lower end of the valve stem, the upper end of the valve stem penetrates the cavity of the powder storing bottle and further extends to the powder outlet, that is, to the upper cap of the powder storing bottle. It means that the valve stem runs through the entire powder storing bottle, from the bottom of the powder storing bottle to the top of the powder storing bottle, which causes interference with the milk powder when it is packaged, and makes it difficult to store the milk powder in the powder storage cavity, thus lead to extremely inconvenient of use. Meanwhile, because the valve stem that penetrates in the center portion is easy to cause the accumulation of milk powder, the milk powder cannot be discharged from the powder outlet smoothly, which affects the accuracy of powder dispensing.

Moreover, the powder outlet switch and the powder outlet are respectively located at both ends of the powder storing bottle, which complicates the structure with the function of fixed amount of powder dispensing. In addition, since the powder storing bottle is divided into three sections, the bottom of the bottle adopts a segmented and short screw thread connection, the bottle mouth section and the bottle body use a short stroke L-shaped buckle and joint surface, which is easy to fall off when accidentally dropped or squeezed, resulting in waste of milk powder.

SUMMARY

One purpose of this application is to solve the above problems and provide corresponding beneficial effects.

Another purpose of this application is to provide a powder dispensing apparatus for dispensing fixed amount of powder and a portable powder storing bottle including the same, thus to improve the accuracy of fixed amount of powder dispensing of the powder storing bottle, and simplify and strength the structure of the powder storing bottle with the function of dispensing fixed amount of powder. The present application is mainly implemented through technical solutions of the following aspects:

<First Aspect of the Present Application>

The first aspect of the present application is to provide a powder dispensing apparatus for dispensing fixed amount of powder, the powder dispensing apparatus includes:

a powder outputting member, a bottle mouth connecting assembly and a plurality of resetting members, the powder outputting member includes a powder outlet, the bottle mouth connecting assembly includes a valve and a bottle mouth connecting member, the bottle mouth connecting member includes a sliding groove, each of the resetting members is located in the sliding groove, one end of each of the resetting members is connected to a bottom of the sliding groove, the other end of each of the resetting members is connected to the powder outputting member, the valve and the powder outlet are detachably connected, a side of the bottle mouth connecting member deviating from the valve is connected to the powder storing bottle;

when the bottle mouth connecting assembly is forced by external force to move towards the powder outputting member, the valve and the powder outlet are departed to dispense a fixed amount of powder; when the external force disappeared, the bottle mouth connecting assembly subjects to an elastic force of the resetting member to return to an original position, the valve and the powder outlet are closed to seal the powder outlet.

According to the first aspect of the present application, the valve which has the similar function of the valve stem of the related art, is configured as a portion of the bottle mouth connecting assembly, the bottle mouth connecting assembly and the powder outputting member are connected, the valve and the powder outlet of the powder outputting member are detachably connected, the side of the bottle mouth connecting member deviating from the valve is connected to the powder storing bottle. As a result, the valve is unnecessary to penetrate the whole powder storing bottle, but also can realize the separating and closing with the powder outlet, thus to avoid interference of milk powder during packaging, to improve the convenience of use of the powder storing bottle, and to improve the accuracy of fixed amount of powder dispensing of the powder storing bottle.

The bottle mouth connecting assembly of the present application is equivalent to a switch for opening or closing the powder outlet, in the present application, the bottle mouth connecting assembly is set to be connected with the powder outputting member, and connected to the powder storing bottle through the side deviating from the valve, thus the entire of the powder dispensing apparatus is located at one side of the powder storing bottle. Compared with the related art which having the structure that the powder outputting switch and the powder outlet are located at two sides of the powder storing bottle respectively, the powder dispensing apparatus for dispensing fixed amount of powder of the present application, that is, the structure having the function of dispensing fixed amount of powder, has a simpler and more reliable structure, smaller in size and is more convenient for use.

In some technical solutions, the powder outputting member further includes a receiving cavity, the powder dispensing apparatus further includes a silicone spacer, and the silicone spacer is located in the receiving cavity.

According to the above technical solutions, milk powder can be prevented from being scattered from portions other than the powder outlet to the outside of the powder dispensing apparatus.

In some technical solutions, the bottle mouth connecting member further includes a connecting portion, the connecting portion is connected with the powder storing bottle by screw thread of the powder storing bottle.

According to the above technical solutions, a tight connection of the powder dispensing apparatus and the powder storing bottle can be realized.

In some technical solutions, the bottle mouth connecting member further includes a plurality of powder outputting channels, the plurality of powder outputting channels are used for powder transferring to the receiving cavity from the powder storing bottle smoothly.

According to the above technical solutions, a transferring path for transferring the milk powder from the powder storing bottle to the powder outlet can be conducted to realize a delivering of fixed amount of powder.

In some technical solutions, the bottle mouth connecting member further includes a fixed portion, the fixed portion crosses a central portion of the silicone spacer and is connected to an end of the valve, the other end of the valve and the powder outlet are detachably connected.

In some technical solutions, the bottle mouth connecting member further includes a plurality of position limiting portions, the powder outputting member further includes a plurality of protruding portions, the protruding portions are located at an outer side wall of the powder outputting member, each of the position limiting portions is used for preventing a corresponding protruding portion sliding out of the sliding groove.

In some technical solutions, the powder dispensing apparatus further includes a decorating member, the bottle mouth connecting member further includes a receiving groove, the receiving groove is used for receive the decorating member.

According to the above technical solutions, the powder dispensing apparatus can be decorated, therefor the powder dispensing apparatus has a more beautiful appearance, thus to meet the aesthetics of consumers better.

In some technical solutions, the sliding groove further includes a plurality of connecting columns, each of the connecting columns is used for fixing a corresponding resetting member.

According to the above technical solutions, shifting of the resetting member can be effectively prevented.

<Second Aspect of the Present Application>

The second aspect of the present application is to provide a portable powder storing bottle, including:

a bottle cap, a powder dispensing apparatus for dispensing fixed amount of powder provided as the first aspect of the present application and a powder storing bottle, the powder dispensing apparatus and the bottle cap are connected through a snap-fit structure, the powder dispensing apparatus and the powder storing bottle are connected through screw thread.

Unless otherwise defined, all technical and scientific terms used herein have the same meaning as commonly understood by one of ordinary skill in the art to which this application belongs.

The various features and implementations of the present application mentioned in the above aspects, depending on the circumstances, can be applied to other aspects with appropriate modifications. Therefore, specific features in one aspect can be combined with other aspects The specific characteristics of the appropriate combination.

Other advantages, objectives and features of the present application will partly be embodied through the following descriptions, and partly will be understood by those skilled in the art through the research and practice of the present application.

BRIEF DESCRIPTION OF DRAWINGS

In order to illustrate the technical solutions of the embodiments of the present application more clearly, the following briefly introduces the accompanying drawings that need to be used in the description of the embodiments of the present application. Obviously, the drawings in the following description are only some embodiments of the present application. For those of ordinary skill in the art, other drawings can also be obtained from these drawings without creative effort.

Figure 1:
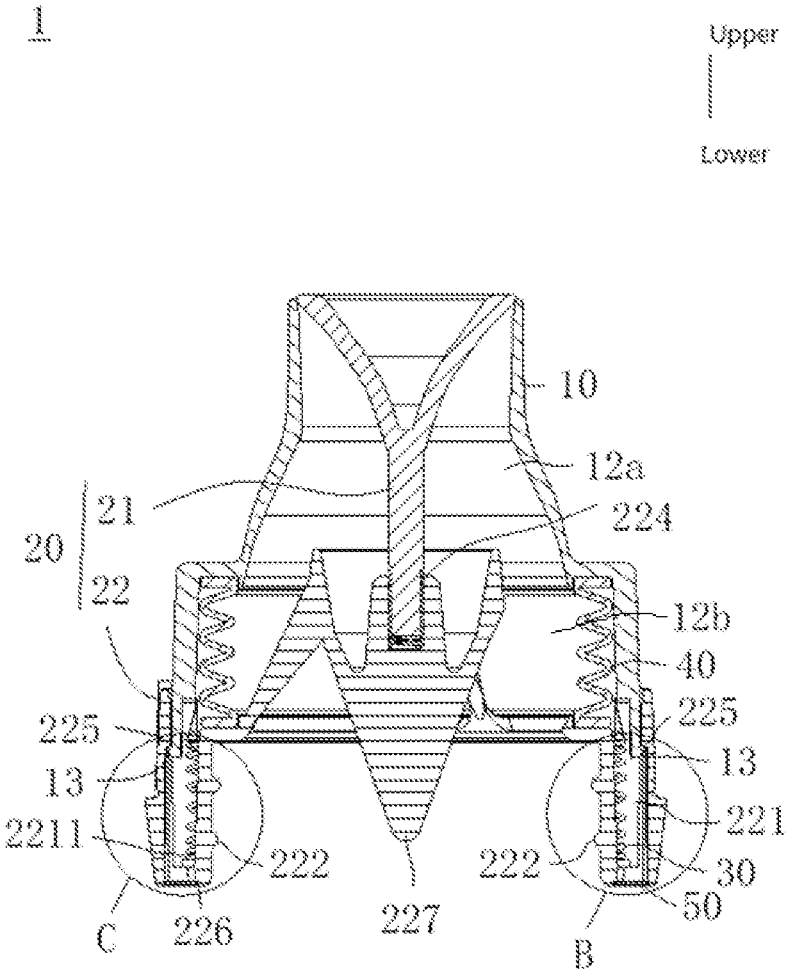
FIG. 1 is a sectional view of a powder dispensing apparatus for dispensing fixed amount of powder according to some embodiments of the present application.
Figure 2:
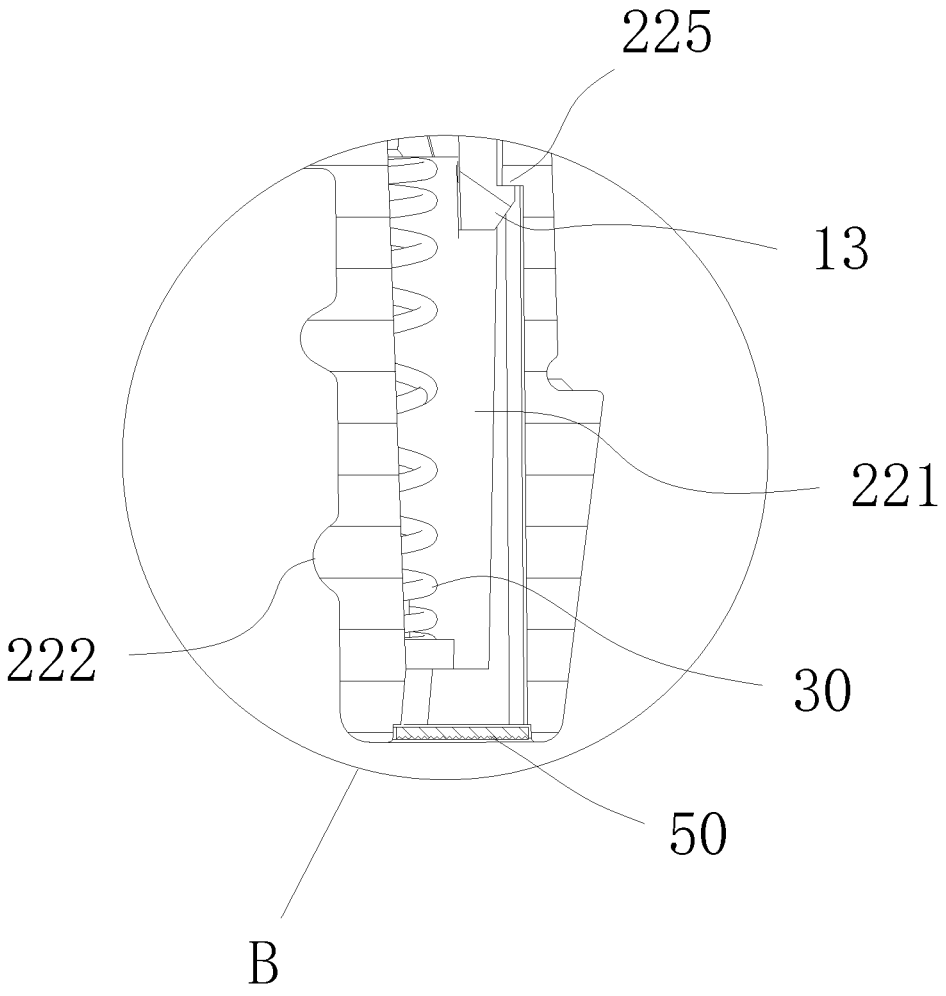
FIG. 2 is an enlarged view of portion B shown in FIG. 1.
Figure 3:
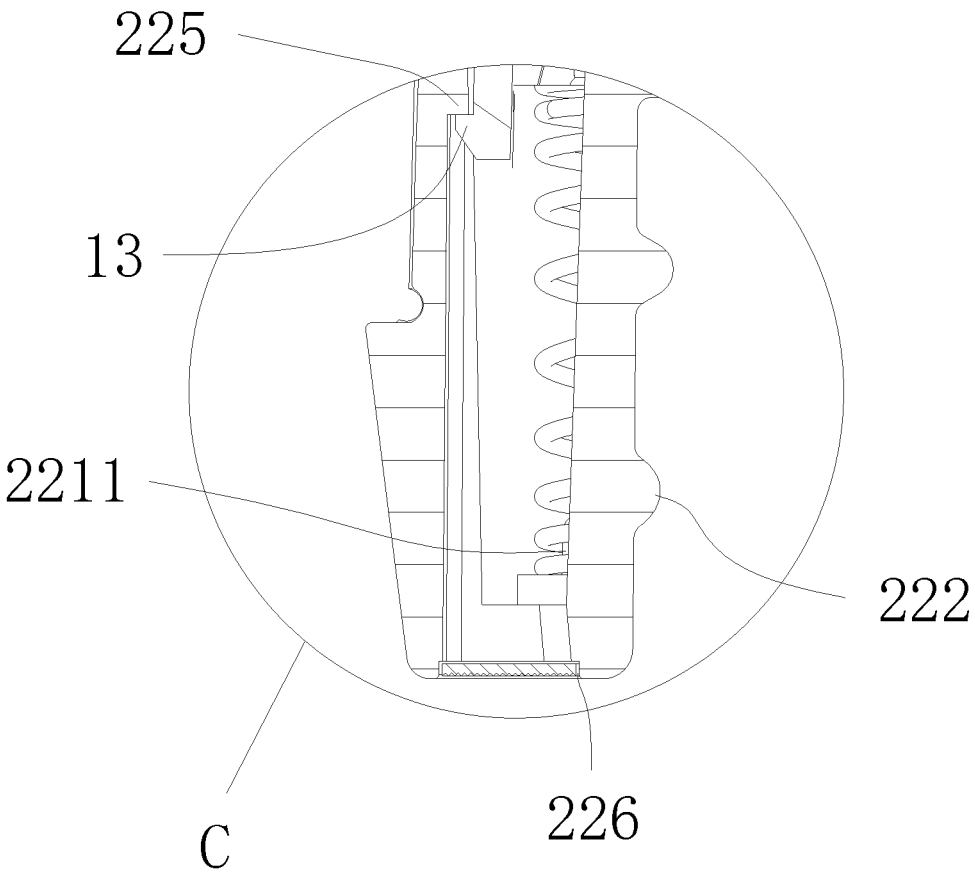
FIG. 3 is an enlarged view of portion C shown in FIG. 1.
Figure 4:
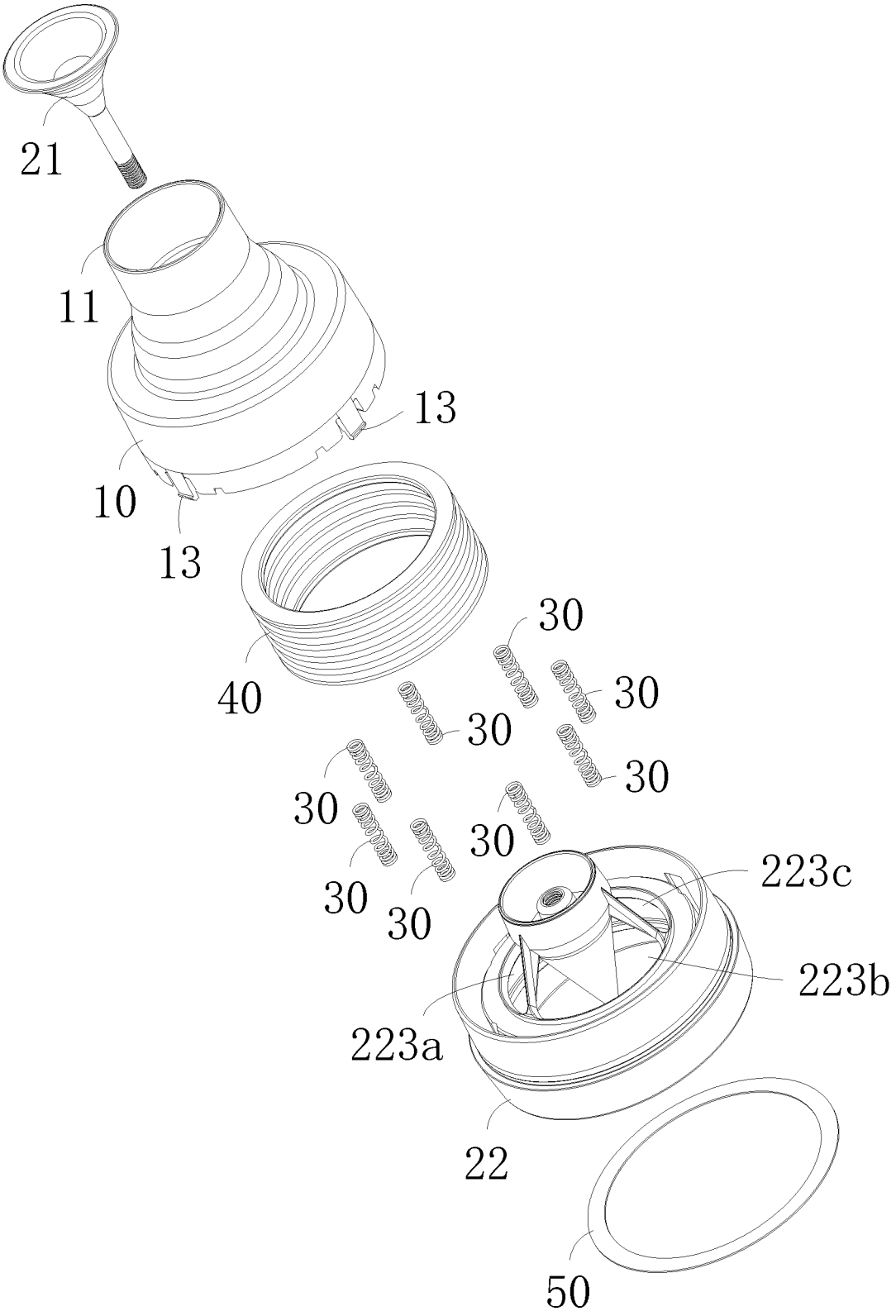
FIG. 4 is an exploded diagram of a powder dispensing apparatus for dispensing fixed amount of powder according to some embodiments of the present application.

Description of reference number in the drawings:

1: powder dispensing apparatus for dispensing fixed amount of powder; 10: powder outputting member; 11: powder outlet; 12*a*: first receiving cavity; 12*b*: second receiving cavity; 13: protruding portion; 20: bottle mouth connecting assembly; 21: valve; 22: bottle mouth connecting member; 221: sliding groove; 2211: connecting column; 222: connecting portion; 223*a*: first powder outputting channel; 223*b*: second powder outputting channel; 223*c*: third powder outputting channel; 224: fixed portion; 225: position limiting portion; 226: receiving groove; 227: conical portion; 30: resetting member; 40: silicone spacer; 50: decorating member; 100: portable powder storing bottle; 101: bottle cap; 102: powder storing bottle; A: baby bottle.

DETAILED DESCRIPTIONS

In order to make the purpose, technical solutions and advantages of the present application clearer, the technical solutions in the embodiments of the present application will be clearly and completely described below with reference to the accompanying drawings of the embodiments of the present application. Obviously, the described embodiments are some of the embodiments of the present application, but not all of the embodiments. Based on the embodiments described in the present application, all other embodiments obtained by those of ordinary skill in the art without creative work belong to the scope of the present application.

The terms "first" and "second" in the description of the embodiments of the present application are used to distinguish different objects, rather than to describe a specific order of the objects. For example, the first receiving cavity and the second receiving cavity are used to distinguish different receiving cavities, rather than being used to describe a specific order of receiving cavities. The orientation or positional relationship indicated by the terms "inside", "middle", "bottom", "top", etc. is based on the orientation or positional relationship shown in the drawings, it is only for the convenience of describing the application and simplifying the description, rather than indicating or implying that the referred device or element must have a specific orientation, be constructed and operate in a specific orientation, and therefore should not be regarded as a limitation to the scope of the application.

In the embodiments of the present application, words such as "exemplary" or "for example" are used to represent examples, illustrations or explanations. Any embodiment described as "exemplary" or "for example" in the embodiments or designs of the present application should not be construed as preferred or advantageous over other embodiments or designs. Rather, use of the words "exemplary" or "such as" is intended to present the relevant concepts in a specific manner.

It should be noted that, in this document, the terms "comprise", "include" or any other variation thereof are intended to cover non-exclusive inclusion, e.g., a process, a method, a system, a product or an apparatus comprising a series of steps or units is not necessary to be limited to those steps or units expressly listed, but may include other steps or units not expressly listed or inherent to these processes, methods, products or devices.

The specific embodiments of the present application will be further described below in conjunction with the accompanying drawings.

<Powder Dispensing Apparatus for Dispensing Fixed Amount of Powder>

As shown in FIG. 1 to FIG. 5, are schematical diagrams of structure of a powder dispensing apparatus for dispensing fixed amount of powder. In FIG. 1 to FIG. 5, the powder dispensing apparatus 1 includes a powder outputting member 10, a bottle mouth connecting assembly 20 and a plurality of resetting members 30. The powder outputting member 10 has a powder outlet 11, the bottle mouth connecting assembly 20 includes a valve 21 and bottle mouth connecting member 22, the bottle mouth connecting member 22 includes a sliding groove 221, each resetting member 30 is located in the sliding groove 221, one end of each resetting member 30 is connected to the bottom of the sliding groove 221, and the other end is connected to the powder outputting member 10, the valve 21 and the powder outlet 11 are detachably connected, a side of the bottle mouth connecting member 22 deviating from the valve 21 is connected to the powder storing bottle 102.

when the bottle mouth connecting assembly 20 is forced by external force to move towards the powder outputting member 10, the valve 21 and the powder outlet 11 are departed to dispense a fixed amount of powder; when the external force disappeared, the bottle mouth connecting assembly 20 subjects to an elastic force provided by the resetting member 30 to return to an original position, the valve 21 and the powder outlet 11 are closed to seal the powder outlet 11.

It should be noted that, in this embodiment the number of the plurality of resetting members 30 can be eight, that is, the apparatus 1 has eight resetting members 30. In some other embodiments, the number of the plurality of resetting members 30 can be set by those skilled in the art according to different requirements, and is not limited to the aforementioned examples of eight resetting members.

The resetting member 30 can be a spring member.

One end of the powder outputting member 10 is set as the powder outlet 11, the other end is connected to the plurality of resetting member 30. In some other embodiments, a retaining ring can be added or attached to the powder outputting member 10 at a position close to the powder outlet 11 to prevent the powder outlet 11 from getting wet.

The bottle mouth connecting member 22 is fixedly connected to the valve 21.

Through the above embodiments of the present application, the valve 21 which has the similar function of the valve stem of the related art, is configured as a portion of the bottle mouth connecting assembly 20, the bottle mouth connecting assembly 20 and the powder outputting member 10 are connected, the valve 21 and the powder outlet 11 of the powder outputting member 10 are detachably connected, the side of the bottle mouth connecting member 22 deviating from the valve 21 is connected to the powder storing bottle 102. As a result, the valve 21 is unnecessary to penetrate the whole powder storing bottle 102, but also can realize the separating and closing with the powder outlet 11, thus to avoid interference of milk powder during packaging, to improve the convenience of use of the powder storing bottle 102, and to improve the accuracy of fixed amount of powder dispensing of the powder storing bottle 102.

The bottle mouth connecting assembly 20 of the present application is equivalent to a switch for opening or closing the powder outlet 11, in the present application, the bottle mouth connecting assembly 20 is set to be connected with the powder outputting member 10, and connected to the powder storing bottle 102 through the side deviating from the valve, thus the entire of the powder dispensing apparatus 1 is located at one side of the powder storing bottle 102. Compared with the related art which having the structure that the powder outputting switch and the powder outlet 11 are located at two sides of the powder storing bottle 102 respectively, the powder dispensing apparatus 1 for dispensing fixed amount of powder of the present application, that is, the structure having the function of dispensing fixed amount of powder, has a simpler and more reliable structure, smaller in size and is more convenient for use.

In some technical solutions, the powder outputting member 10 further includes a receiving cavity, the powder dispensing apparatus 1 further includes a silicone spacer 40, and the silicone spacer 40 is located in the receiving cavity. In addition to being an integrally formed structure, in some other embodiments, the powder outputting member 10 may be assembled from two detachable parts. For example, the lower half of the powder outputting member 10 shown in FIG. 1, which receives the silicone spacer 40, and the upper part can be designed as two independent accessories, and the two independent accessories can be fastened and connected by means of threaded connection to form a complete powder outputting member 10, which is convenient for cleaning the powder dispensing apparatus 1.

Figure 5:
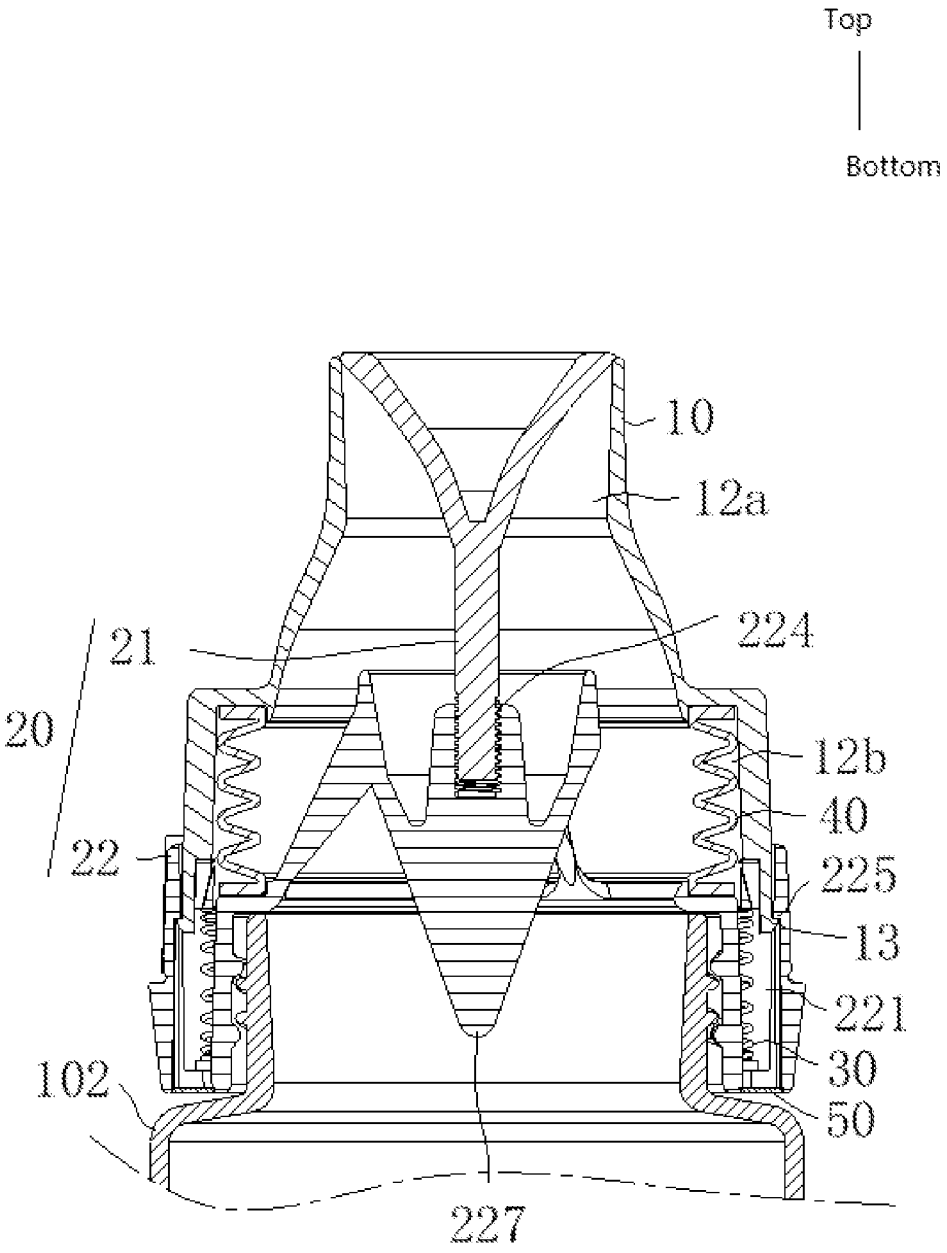
FIG. 5 is a sectional view of a powder dispensing apparatus for dispensing fixed amount of powder according to some other embodiments of the present application.
Figure 6:
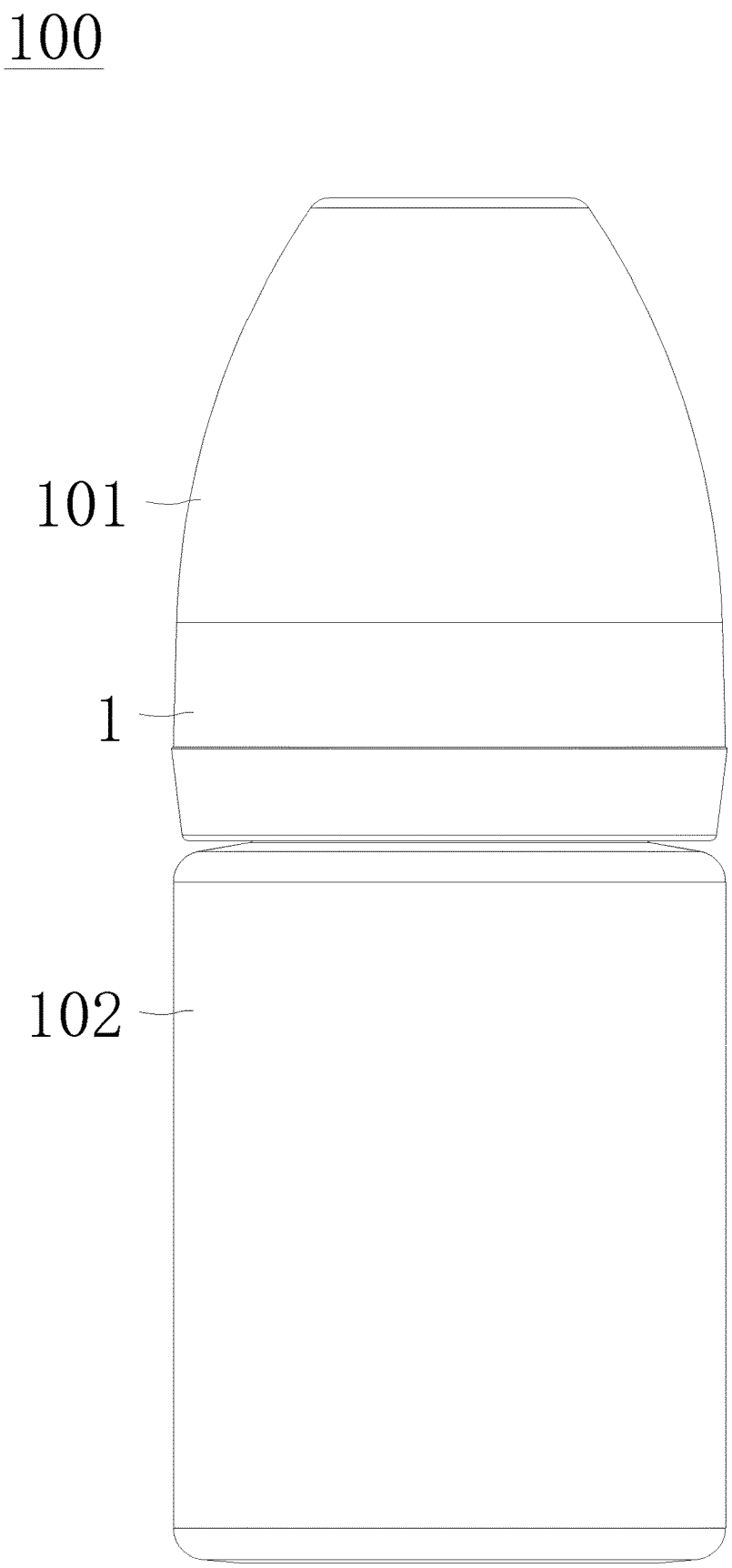
FIG. 6 is a schematical diagram of a portable powder storing bottle according to some embodiments of the present application.
Figure 7:
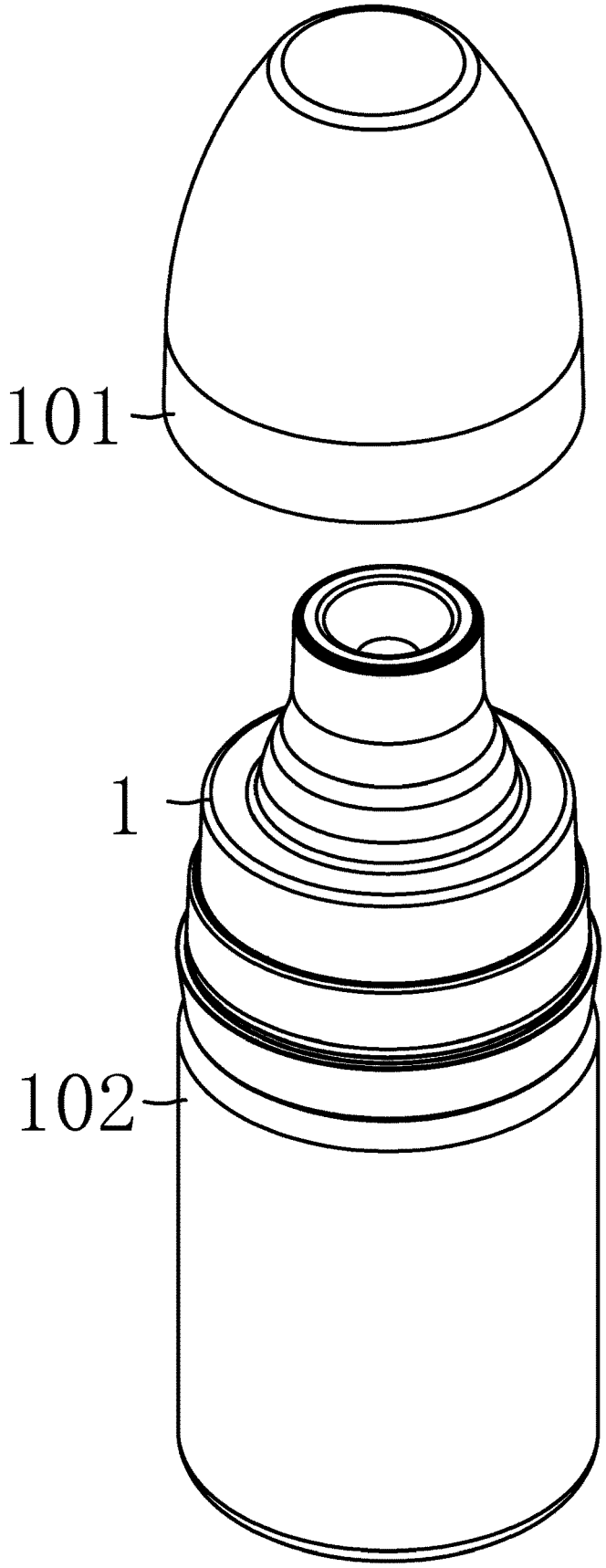
FIG. 7 is a partially exploded diagram of a portable powder storing bottle according to some embodiments of the present application.
Figure 8:
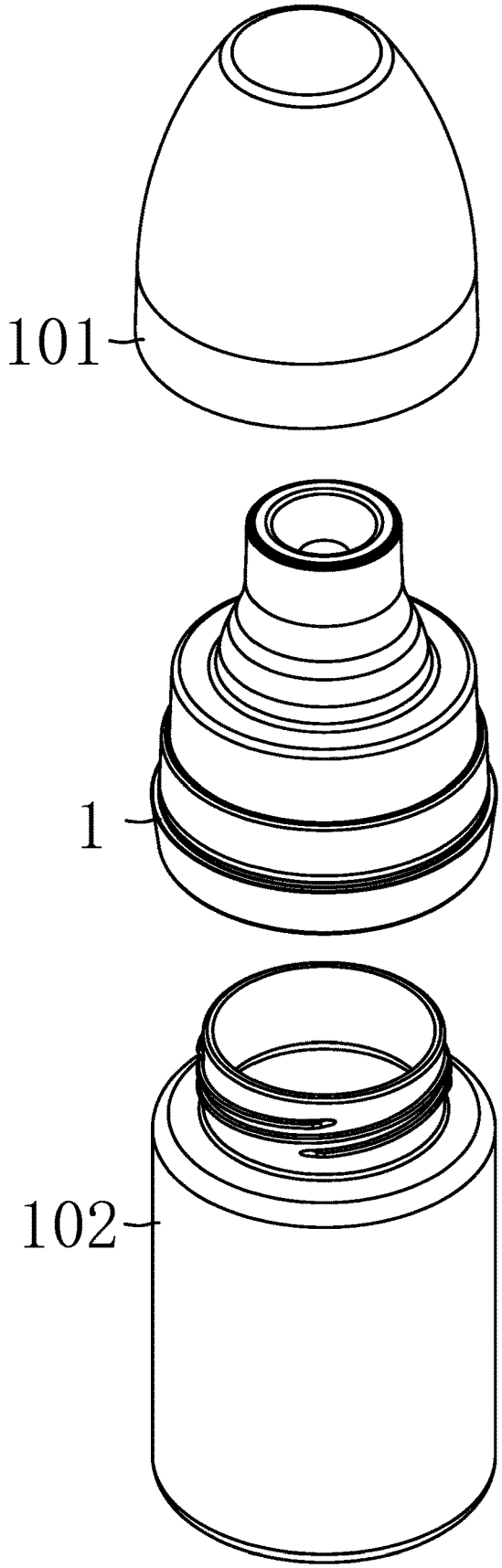
FIG. 8 is a partially exploded diagram of a portable powder storing bottle according to some other embodiments of the present application.
Figure 9:
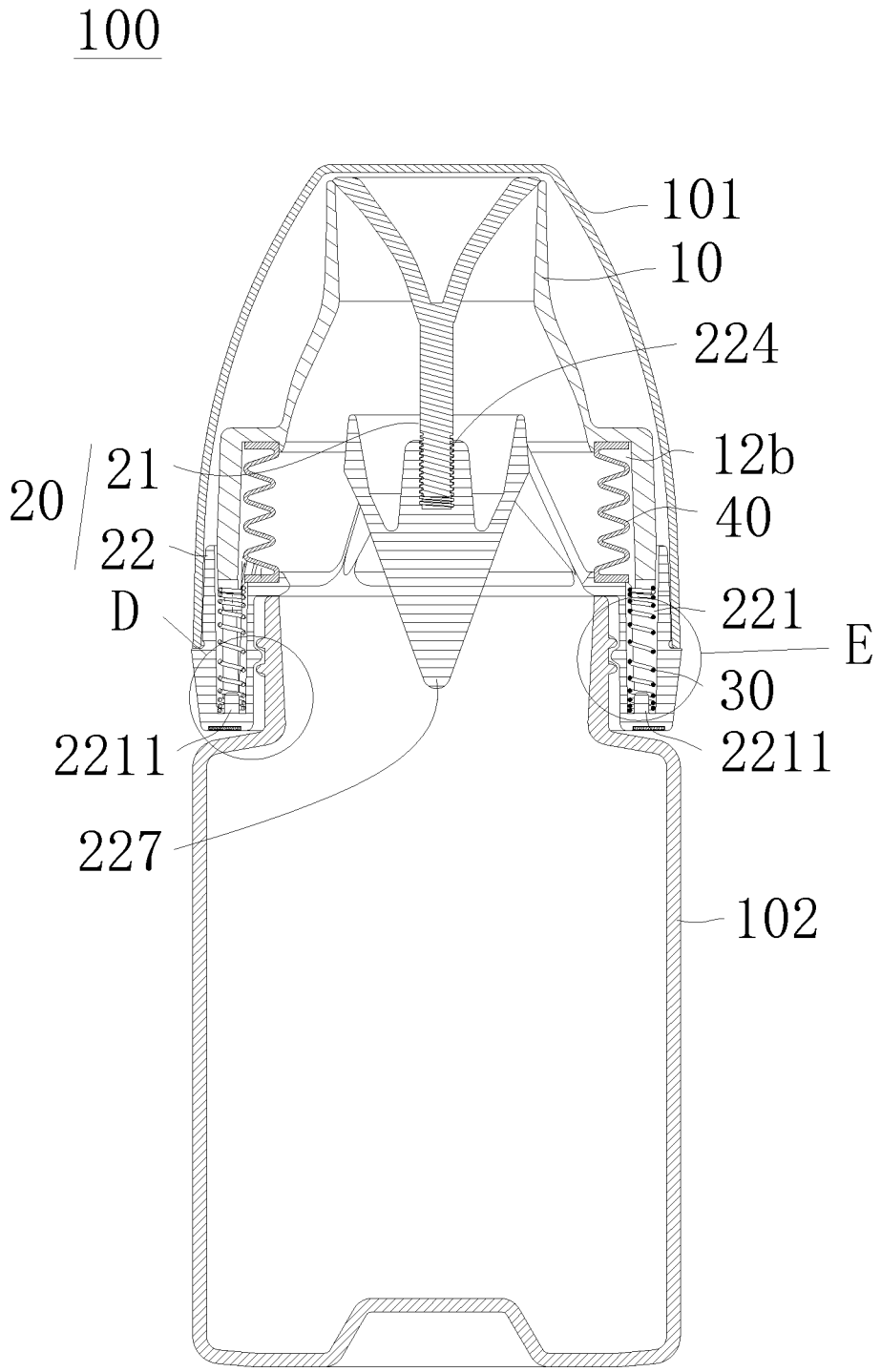
FIG. 9 is a sectional view of a portable powder storing bottle according to some embodiments of the present application.
Figure 10:
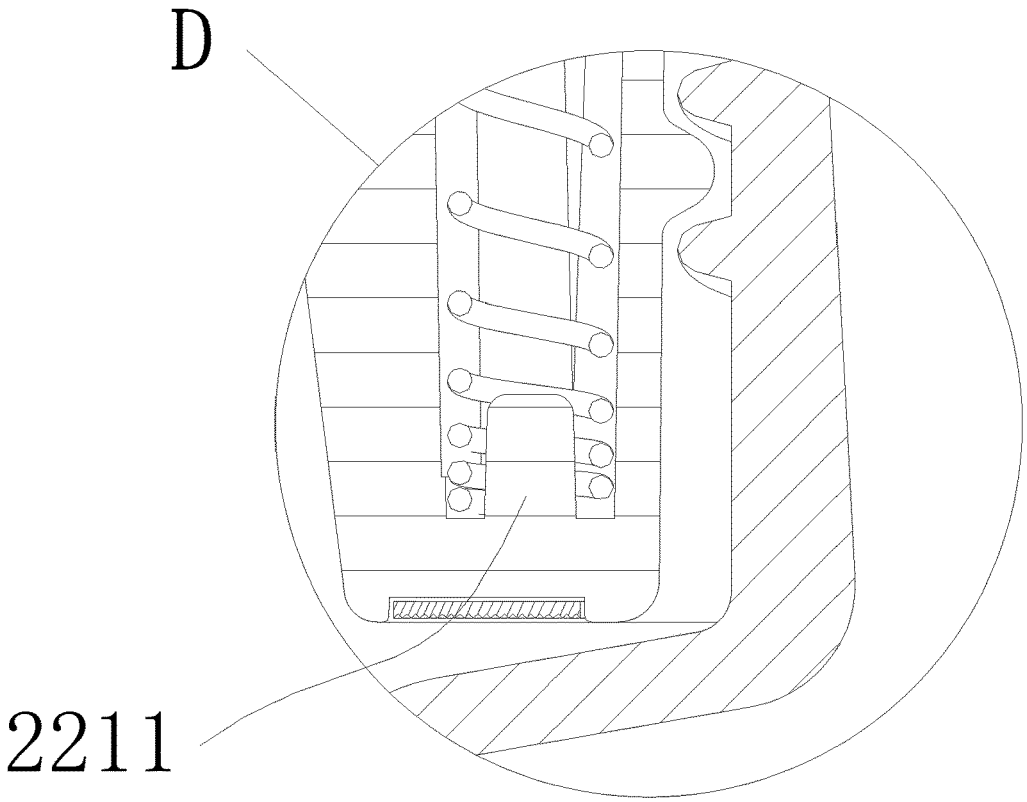
FIG. 10 is an enlarged view of portion D shown in FIG. 9.
Figure 11:
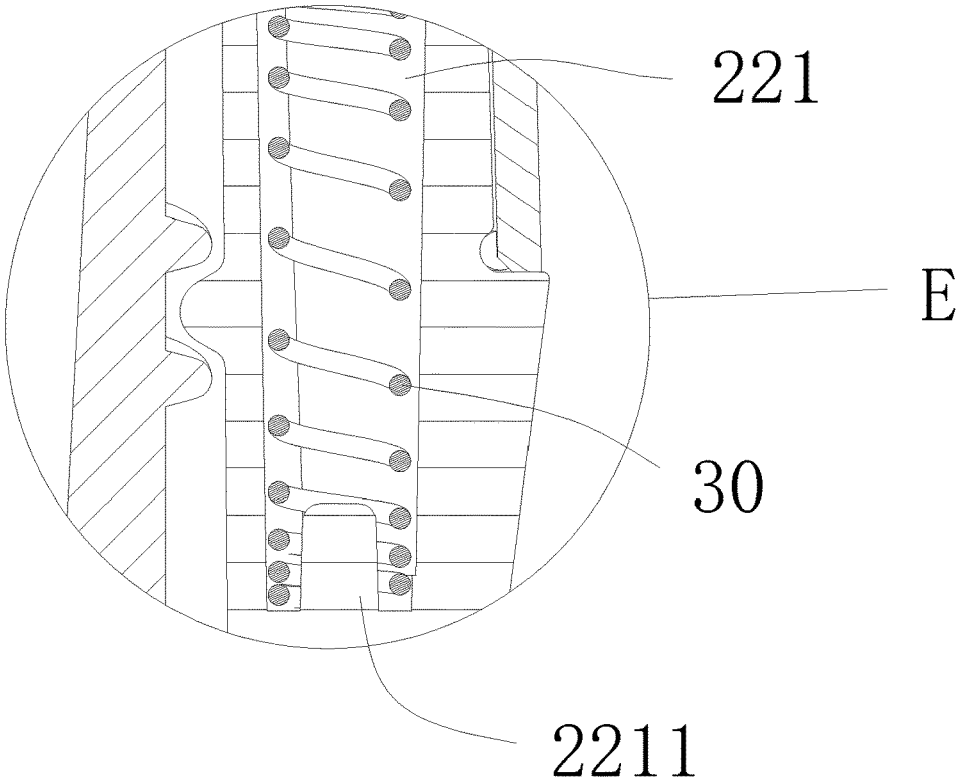
FIG. 11 is an enlarged view of portion E shown in FIG. 9.
Figure 12:
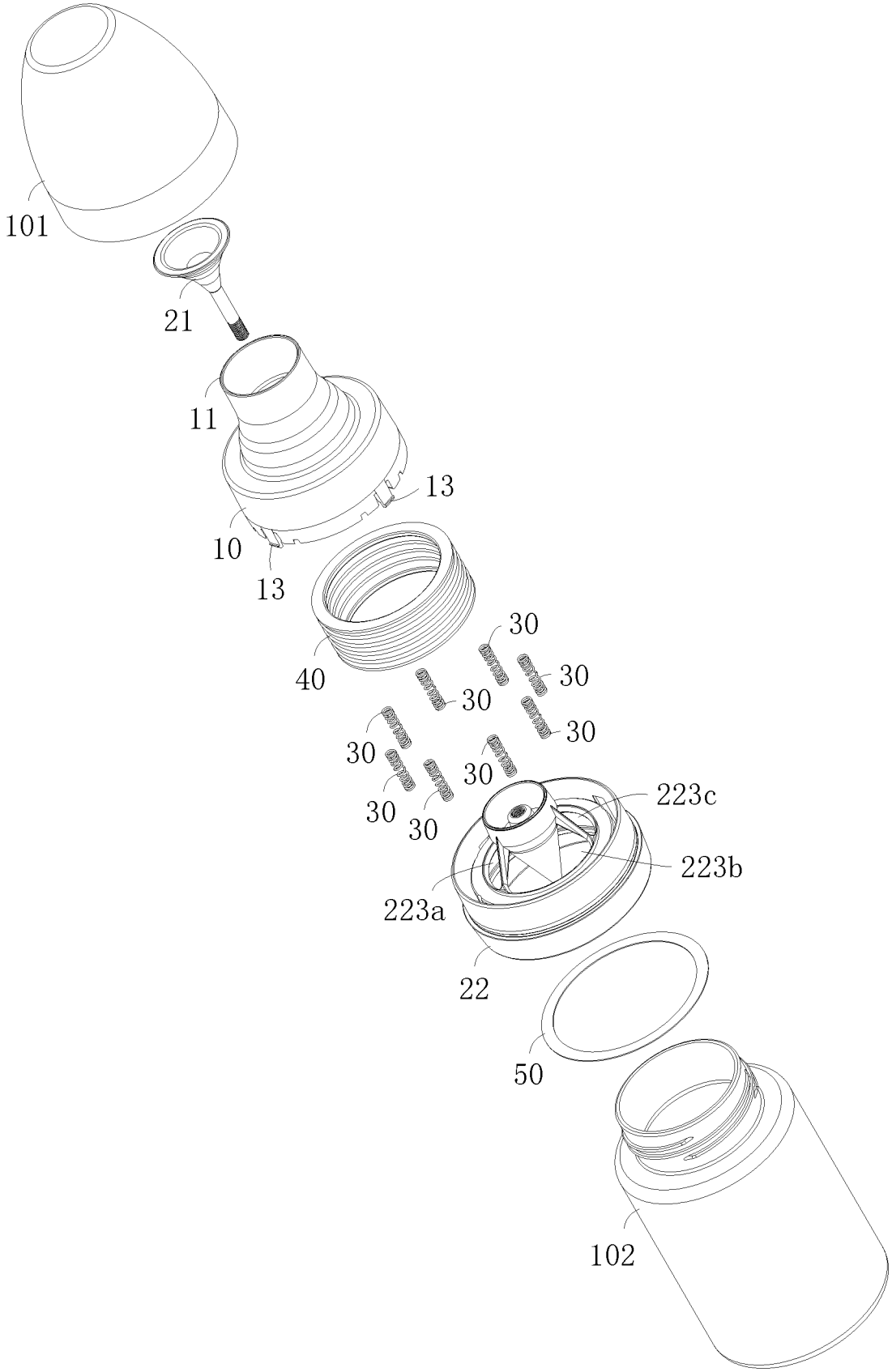
FIG. 12 is and exploded diagram of a portable powder storing bottle according to some embodiments of the present application.

The receiving cavity may include a first receiving cavity 12*a* 和 a second receiving cavity 12*bc*. As shown in FIG. 1 and FIG. 5, the first receiving cavity 12*a* and the powder outlet 11 are conducted, the second receiving cavity 12*b* is used to receive the silicone spacer 40.

According to the above embodiments, milk powder can be prevented from being scattered between the powder outputting member 10 and the bottle mouth connecting member 22.

In some embodiments, the bottle mouth connecting member 22 further includes a connecting portion 222, the connecting portion 222 is connected with the powder storing bottle 102 by screw thread connection.

The connecting portion 222 is located one the inner side wall of the bottle mouth connecting member 22.

According to the above embodiments, a tight connection of the powder dispensing apparatus 1 and the powder storing bottle 103 can be realized.

In some technical solutions, the bottle mouth connecting member 22 further includes a plurality of powder outputting channels, the plurality of powder outputting channels are used for a predetermined amount of powder transferring to the receiving cavity from the powder storing bottle 102.

The plurality of powder outputting channels include a first powder outputting channel 223*a*, a second powder outputting channel 223*b* and a third powder outputting channel 223*c*. In other embodiments, the number of the powder outputting channels can be set by those skilled in the art according to different requirements, and are not limited further by the present application.

According to the above embodiments, a transferring path for transferring the milk powder from the powder storing bottle 102 to the powder outlet 11 can be conducted to realize a delivering of fixed amount of powder.

In some embodiments, the bottle mouth connecting member 22 further includes a fixed portion 224, the fixed portion 224 crosses a central portion of the silicone spacer 40 and is connected to an end of the valve 21, the other end of the valve 21 and the powder outlet 11 are detachably connected.

The fixed portion 224 can be a groove, the side wall of the groove has screw thread, one end of the valve 21 is connected to the groove through the screw thread. The manner and shape of connection between the valve 21 and the fixed portion 224 including but not limited to screw-thread connection described in the above example, it can also be a buckle manner, a welding manner, etc., or can be specifically configured by those skilled in the art according to requirements.

In some embodiments, the bottle mouth connecting member 22 further includes a plurality of position limiting portions 225, the powder outputting member 10 further includes a plurality of protruding portions 13, the protruding portions 13 are located at an outer side wall of the powder outputting member 10, each of the position limiting portions 225 is used for preventing a corresponding protruding portion 13 sliding out of the sliding groove 221.

The number of the position limiting portions 225 can be four, the number of the protruding portions 13 is identical to the number of the position limiting portions 225. In some other embodiments, the number of the protruding portions 13 and the number of the position limiting portions 225 can be specifically set by those skilled in the art according to requirements.

In some embodiments, the powder dispensing apparatus 1 further includes a decorating member 50, the bottle mouth connecting member 22 further includes a receiving groove 226, the receiving groove 226 is used for receive the decorating member 50.

The receiving groove 226 is located at the bottom of the bottle mouth connecting member 22, the receiving groove 226 has a ring shape, the shape of the decorating member 50 matches the shape of the receiving groove 226. In some other embodiments, the receiving groove 226 can be other shapes.

According to the above embodiments, the powder dispensing apparatus 1 can be decorated, therefor the powder dispensing apparatus 1 has a more beautiful appearance, thus to meet the aesthetics of consumers better.

In some embodiments, the sliding groove 221 further includes a plurality of connecting columns 2211, each of the connecting columns 2211 is used for fixing a corresponding resetting member 30.

The number of the connecting columns 2211 can be identical to the number of the resetting members 30. The plurality of connecting columns 2211 are located at the bottom of the sliding groove 221. Each of the connecting columns 2211 has a cylindrical shape. Of course, in some other embodiments the shape of each connecting column 2211 can be different.

According to the above embodiments, shifting of the resetting member 30 can be effectively prevented.

In some embodiments, the bottle mouth connecting member 22 includes a conical portion 227 which is located at a central portion of the bottle mouth connecting member 22. The conical portion 227 extends through the opening of powder storing bottle 102 to the inner of the powder storing bottle 102 when the powder dispensing apparatus 1 and the powder storing bottle 102 are connected, thus to facility the discharging of the milk powder from the powder storing bottle 102.

When applied in actual user applications, the working principle of the powder dispensing apparatus 1 can be implemented according to the following example (please refer to FIG. 1 and FIG. 13):

The user can place the powder dispensing apparatus 1 upside down, then press the bottle mouth connecting member 22, the bottle mouth connecting member 22 drives the valve 21 to move downward, thus the valve 21 and the powder outlet 11 are departed. Therefore, the first receiving cavity 12*a* are conducted with outside of the powder dispensing apparatus 1 to realize the function of fixed amount of powder dispending. When the user cancels the operation of pressing the bottle mouth connecting member 22, and does not touch the bottle mouth connecting member 22, thus the bottle mouth connecting member 22 is subject to elastic force of the resetting member 30 and rebounded to the original position, the valve 21 and the powder outlet 11 are closed, then the powder outlet 11 is sealed by the valve 21, the first receiving cavity 12*a* is isolated from the outside of the powder dispensing apparatus 1.

In this embodiment, each time pressing the bottle mouth connecting member 22, a standard serving amount, such as 5 g-10 g of milk powder can be dispensed. Of course, in other embodiments, the amount of dispensed milk powder can be set by those skilled in the art according to different demands.

<Portable Powder Storing Bottle>

Please refer to FIG. 6-FIG. 13, a portable powder storing bottle 100 provided by the present application is shown, the portable powder storing bottle 100 includes:

a bottle cap 101, a powder dispensing apparatus 1 for dispensing fixed amount of powder provided as the first aspect of the present application and a powder storing bottle 102, the bottle cap 101 and the powder dispensing apparatus 1 are connected through a snap-fit structure, the powder dispensing apparatus 1 and the powder storing bottle 102 are connected through screw thread.

Figure 13:
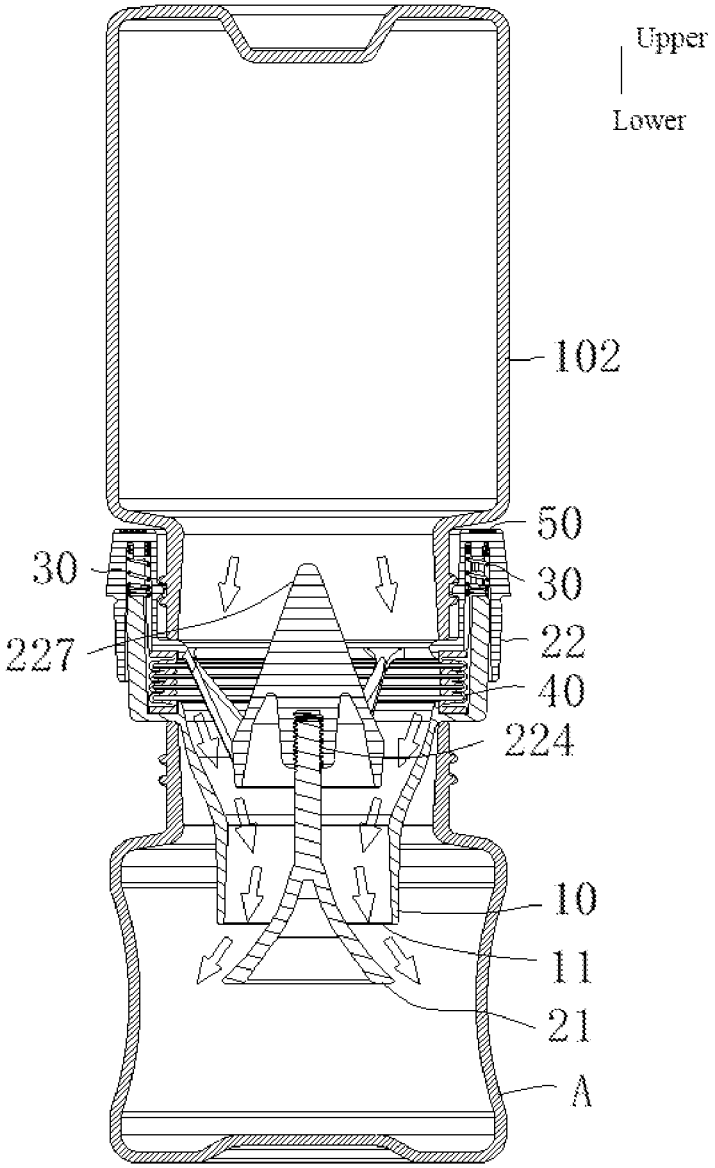
FIG. 13 is a schematical view showing a working principle of the portable powder storing bottle.

When applied in actual user applications, the working principle of the portable powder storing bottle 100 can be implemented according to the following example (please refer to FIG. 13):

The user can take off the bottle cap 101, put the powder dispensing apparatus 1 and the powder storing bottle 102 upside down on the baby bottle A, press the powder storing bottle 102 downward by a hand or hands, the milk powder in the powder storing bottle 102 is dispensed into the baby bottle A along the direction labeled by arrows shown in FIG. 13. When the user cancels the operation of pressing the powder storing bottle 102, and does not touch the powder storing bottle 102, thus the powder storing bottle 102 is subject to elastic force of the resetting member 30 of the powder dispensing apparatus 1 and rebounded to the original position, the valve 21 of the powder dispensing apparatus 1 and the powder outlet 11 of the powder dispensing apparatus 1 are closed, then the powder outlet 11 is sealed by the valve 21, the milk powder in the powder storing bottle 102 will not be dispensed downwardly.

The above describes embodiments of the present application, and these descriptions are not intended to limit the scope of the application and what is shown in the drawings are only one of the embodiments of the present application, and the actual structure is not limited thereto. In a word, any structural means and embodiments similar to the described embodiment which can be designed by those skilled in art inspired thereby, without departing from the creation purpose of the present application and without creativity shall fall within the scope of the present application. It will be understood by those having skill in the art that many changes may be made to the details of the above-described embodiments without departing from the underlying principles of the invention. The scope of the present disclosure should, therefore, be determined only by the following claims.

What is claimed is:

1. A powder dispensing apparatus for dispensing fixed amount of powder, comprising:

a powder outputting member, a bottle mouth connecting assembly and a plurality of resetting members, the powder outputting member comprises a powder outlet, the bottle mouth connecting assembly comprises a valve and a bottle mouth connecting member, the bottle mouth connecting member comprises a sliding groove, each of the resetting members is located in the sliding groove, one end of each of the resetting members is connected to a bottom of the sliding groove, the other end of each of the resetting members is connected to the powder outputting member, the valve and the powder outlet are detachably connected, a side of the bottle mouth connecting member deviating from the valve is connected to a powder storing bottle;

when the bottle mouth connecting assembly is forced by external force to move towards the powder outputting member, the valve and the powder outlet are separated to dispense a fixed amount of powder; when the external force is removed, the bottle mouth connecting assembly subjects to an elastic force of the resetting members to return to an original position, where the valve and the powder outlet are closed to seal the powder outlet.

2. The powder dispensing apparatus of claim 1, wherein the powder outputting member further comprises a receiving cavity, the powder dispensing apparatus further comprises a silicone spacer, and the silicone spacer is located in the receiving cavity.

3. The powder dispensing apparatus of claim 2, wherein the bottle mouth connecting member further comprises a connecting portion, the connecting portion is connected with the powder storing bottle by screw thread of the powder storing bottle.

4. The powder dispensing apparatus of claim 3, wherein the bottle mouth connecting member further comprises a plurality of powder outputting channels, the plurality of powder outputting channels are used for powder transferring to the receiving cavity from the powder storing bottle smoothly.

5. The powder dispensing apparatus of claim 4, wherein the bottle mouth connecting member further comprises a fixed portion, the fixed portion crosses a central portion of the silicone spacer and is connected to an end of the valve, the other end of the valve and the powder outlet are detachably connected.

6. The powder dispensing apparatus of claim 5, wherein the bottle mouth connecting member further comprises a plurality of position limiting portions, the powder outputting member further comprises a plurality of protruding portions, the protruding portions are located at an outer side wall of the powder outputting member, each of the position limiting portions is used for preventing a corresponding protruding portion sliding out of the sliding groove.

7. The powder dispensing apparatus of claim 6, further comprising a decorating member, wherein the bottle mouth connecting member further comprises a receiving groove, the receiving groove is used for receiving the decorating member.

8. The powder dispensing apparatus of claim 7, wherein the sliding groove further comprises a plurality of connecting columns, each of the connecting columns is used for fixing a corresponding resetting member.

9. A portable powder storing bottle, comprising:

a bottle cap;

a powder storing bottle; and a powder dispensing apparatus for dispensing fixed amount of powder, wherein the powder dispensing apparatus and the bottle cap are connected through a snap-fit structure, the powder dispensing apparatus and the powder storing bottle are connected through screw thread, and the powder dispensing apparatus comprises:

a powder outputting member, a bottle mouth connecting assembly and a plurality of resetting members, the powder outputting member comprises a powder outlet, the bottle mouth connecting assembly comprises a valve and a bottle mouth connecting member, the bottle mouth connecting member comprises a sliding groove, each of the resetting members is located in the sliding groove, one end of each of the resetting members is connected to a bottom of the sliding groove, the other end of each of the resetting members is connected to the powder outputting member, the valve and the powder outlet are detachably connected, a side of the bottle mouth connecting member deviating from the valve is connected to the powder storing bottle;

when the bottle mouth connecting assembly is forced by external force to move towards the powder outputting member, the valve and the powder outlet are members to dispense a fixed amount of powder; when the external force is removed, the bottle mouth connecting assembly subjects to an elastic force of the resetting members to return to an original position, where the valve and the powder outlet are closed to seal the powder outlet.

10. The portable powder storing bottle of claim 9, wherein the powder outputting member further comprises a receiving cavity, the powder dispensing apparatus further comprises a silicone spacer, and the silicone spacer is located in the receiving cavity.

11. The portable powder storing bottle of claim 10, wherein the bottle mouth connecting member further comprises a connecting portion, the connecting portion is connected with the powder storing bottle by screw thread of the powder storing bottle.

12. The portable powder storing bottle of claim 11, wherein the bottle mouth connecting member further comprises a plurality of powder outputting channels, the plurality of powder outputting channels are used for powder transferring to the receiving cavity from the powder storing bottle smoothly.

13. The portable powder storing bottle of claim 12, wherein the bottle mouth connecting member further comprises a fixed portion, the fixed portion crosses a central portion of the silicone spacer and is connected to an end of the valve, the other end of the valve and the powder outlet are detachably connected.

14. The portable powder storing bottle of claim 13, wherein the bottle mouth connecting member further comprises a plurality of position limiting portions, the powder outputting member further comprises a plurality of protruding portions, the protruding portions are located at an outer side wall of the powder outputting member, each of the position limiting portions is used for preventing a corresponding protruding portion sliding out of the sliding groove.

15. The portable powder storing bottle of claim 14, wherein the powder dispensing apparatus further comprises a decorating member, wherein the bottle mouth connecting member further comprises a receiving groove, the receiving groove is used for receiving the decorating member.

16. The portable powder storing bottle of claim 15, wherein the sliding groove further comprises a plurality of connecting columns, each of the connecting columns is used for fixing a corresponding resetting member.

* * * * *